US007900491B2

(12) United States Patent
Chong

(10) Patent No.: US 7,900,491 B2
(45) Date of Patent: Mar. 8, 2011

(54) REKEYABLE LOCK ASSEMBLY AND METHOD OF OPERATION

(75) Inventor: Gerald B. Chong, Rowland Heights, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 12/444,471

(22) PCT Filed: Dec. 4, 2006

(86) PCT No.: PCT/US2006/061556

§ 371 (c)(1),
(2), (4) Date: Apr. 6, 2009

(87) PCT Pub. No.: WO2009/008852

PCT Pub. Date: Jan. 15, 2009

(65) Prior Publication Data

US 2010/0037666 A1 Feb. 18, 2010

Related U.S. Application Data

(60) Provisional application No. 60/828,093, filed on Oct. 4, 2006.

(51) Int. Cl.
*E05B 29/04* (2006.01)

(52) U.S. Cl. ..... 70/492; 70/383; 70/384; 70/493; 70/495

(58) Field of Classification Search ..... 70/382–385, 70/337–343, 368, 492, 493, 495
See application file for complete search history.

(56) References Cited

U.S. PATENT DOCUMENTS

| | | | | |
|---|---|---|---|---|
| 6,860,131 | B2 * | 3/2005 | Armstrong et al. | 70/492 |
| 7,007,528 | B2 * | 3/2006 | Chong et al. | 70/492 |
| 7,377,146 | B2 * | 5/2008 | Field et al. | 70/495 |

* cited by examiner

*Primary Examiner* — Lloyd A Gall
(74) *Attorney, Agent, or Firm* — Richard J. Veltman; John D. Delponti

(57) ABSTRACT

A lock cylinder has a reset condition wherein the lock cylinder can be put into a "learn" mode. In the "learn" mode, the original key can be removed and replaced by replacement key and, when the replacement key is removed, the lock cylinder 10 is rekeyed to the new key. The original key no longer operates the rekeyed lock cylinder 10.

11 Claims, 6 Drawing Sheets

REKEYABLE LOCK ASSEMBLY AND METHOD OF OPERATION

The present invention relates generally to lock cylinders and particularly to lock cylinders that can be rekeyed. More particularly, the invention relates to lock cylinders that can be rekeyed in situ and without using a master key.

BACKGROUND OF THE INVENTION

Rekeying a conventional lock cylinder is a task best left to a professional locksmith because it involves removing the lock cylinder from the lock installation and then disassembling it. The original pins are then replaced by different pins to accommodate the cut of the new key, and the lock is reassembled. This requires a working knowledge of the lockset and cylinder mechanism and requires access to replacement pins.

These considerations can intimidate an ordinary consumer, prompting the hire a professional locksmith or to buy a new lockset. Either way, the consumer must spend money. In addition, professionals using appropriate tools can easily pick traditional cylinders.

The present invention overcomes these and other disadvantages of conventional lock cylinders. The lock cylinder of the present invention operates in a transparent way that presents the familiar experience of inserting a key and rotating the key in the lock cylinder, as with current cylinders. However, in the present invention, that same familiar experience is used to rekey the lock cylinder. Thus, the user does not require any special knowledge, training, or tools to rekey the lock cylinder of the present invention.

SUMMARY OF THE INVENTION

A rekeyable lock cylinder includes a housing and a plug assembly. The plug assembly includes a plug body and a carrier, a plurality of pins disposed in the plug body, a plurality of racks disposed in the carrier for engaging the pins, and a locking bar disposed in the carrier for engaging the housing. When the plug body is rotated from a home position to a second position within the housing, the locking bar aligns with a reset groove formed in the housing. While the plug assembly is in the second position, the carrier is moved longitudinally relative to the plug body to a learn position, allowing the locking bar to enter the reset groove, thereby locking the carrier in the learn position. At the same time, the racks disengage from the pins. In the learn position, the original key is removed and a replacement key is inserted into the lock cylinder. Being disengaged from the racks, the pins are free to accommodate the bitting of a replacement key. With the replacement key in the lock cylinder, the plug assembly is rotated from the second position, causing the carrier to move out of the learn position and the racks to reengage the pins in response to movement of the carrier, whereupon the lock cylinder is keyed to the replacement key.

In operation, a user inserts a valid key in the lock and rotates the plug assembly to a reset position. The user then pushes against the carrier by inserting a tool in an aperture in the lock face, or depressing an internally mounted push button or the like. Pushing the carrier moves it longitudinally to a learn position, where the locking bar engages a reset groove in the cylinder housing side wall. Features on the locking bar cooperate with complementary features in the reset groove to retain the carrier in the learn position.

When the carrier is in the learn position, the user withdraws the valid key, inserts a replacement key with different bitting, and rotates the plug assembly from the reset position. The rotation of the plug assembly cams the locking bar out of the reset groove, allowing a biasing spring to move the carrier back to its original position. At this point, the lock cylinder is keyed to the replacement key and the original valid key no longer operates the lock.

Other features and advantages will become apparent from the following description when viewed in accordance with the accompanying drawings and appended claims.

DETAILED DESCRIPTION OF THE DRAWINGS

As with conventional lock cylinders, the present cylinder 10 has a locked condition and an unlocked condition. However, the present lock cylinder 10 further includes a reset condition wherein the lock cylinder can be put into a "learn" mode. In the "learn" mode, the original key can be removed and replaced by another key and, when the new key is removed, the lock cylinder 10 is rekeyed to the new key. The original key no longer operates the rekeyed lock cylinder 10.

Figure 1:
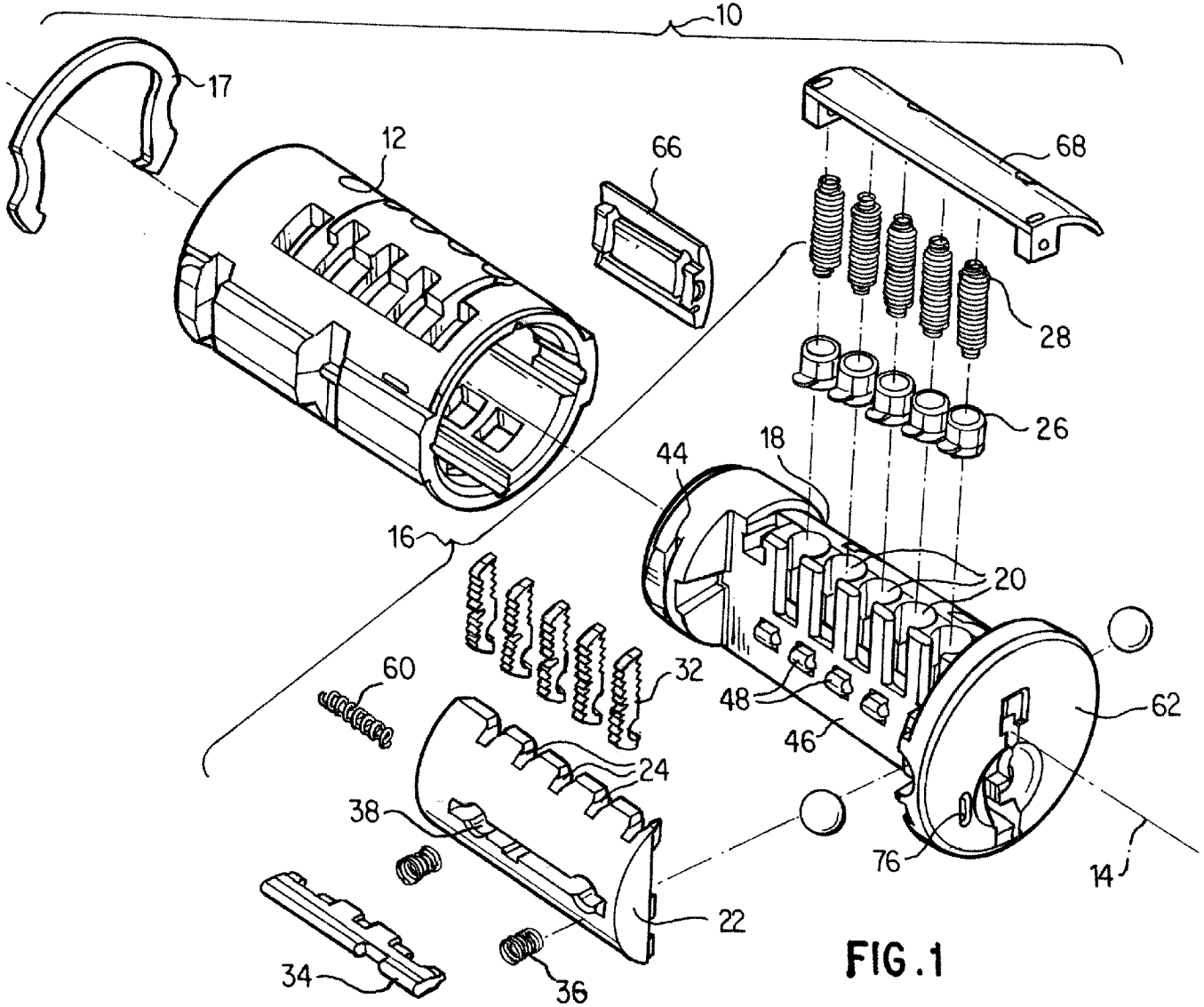
FIG. 1 is an exploded view of a lock cylinder according to the present invention.
Figure 2:
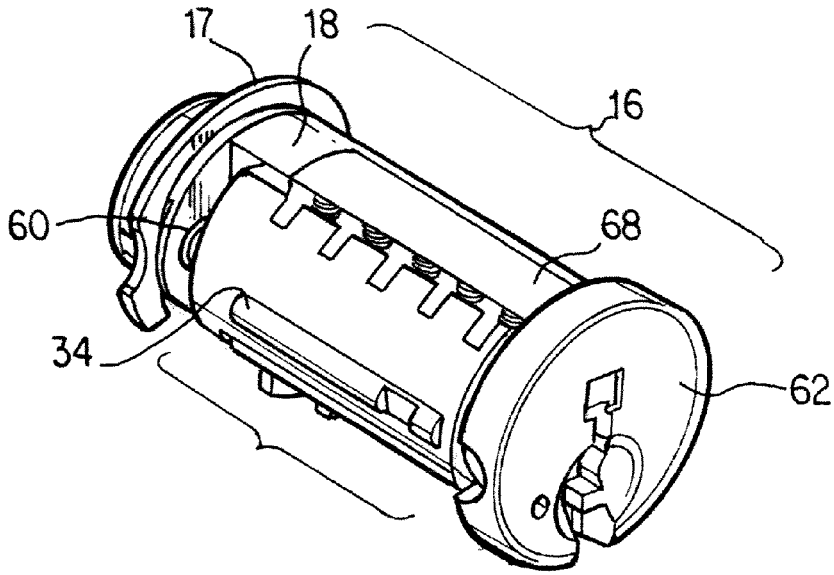
FIG. 2 is a perspective view of a plug assembly.

The lock cylinder 10 according to the present invention is illustrated in FIG. 1-2 and includes a cylinder housing 12 having a longitudinal axis 14, a plug assembly 16, and a retainer 17. The plug assembly 16 includes a plug body 18 defining a plurality of pin chambers 20, and a carrier 22 defining a plurality of slots 24. The plug body 18 further includes a generally planar surface 46 that has a plurality of reset alignment features 48. The retainer 17 engages grooves 44 cut in the plug body 18 to retain the plug assembly 16 in the cylinder housing 12.

A plurality of pins 26 and springs 28 are disposed in the pin chambers 20, and a plurality of racks 32 is disposed in the slots 24. A locking bar 34 and biasing springs 36 are disposed in a locking bar-receiving chamber 38 formed in the carrier 22.

Figure 7:
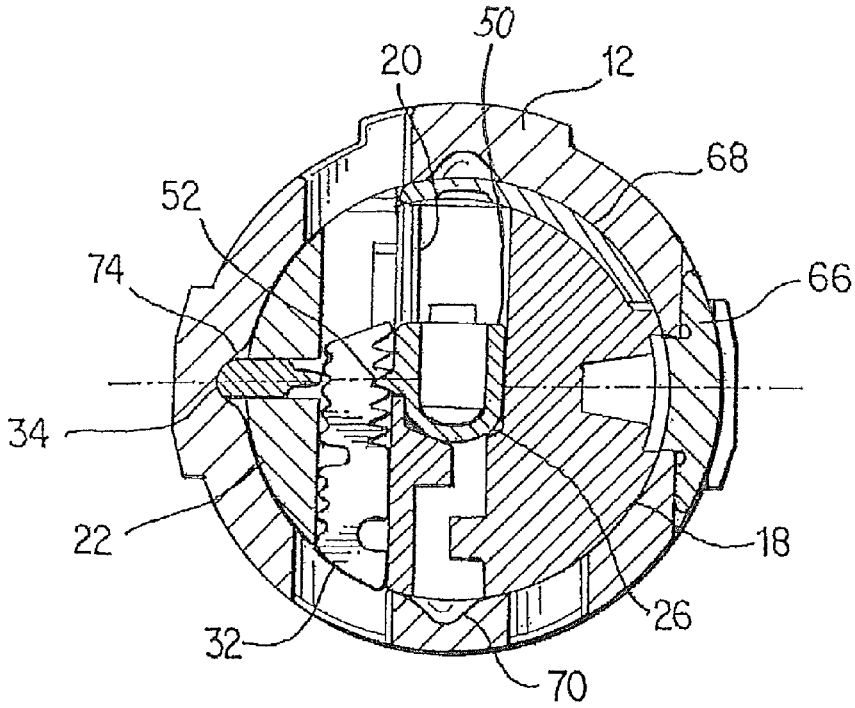
FIG. 7 is a section view through an assembled lock cylinder in a locked configuration.

As best seen in FIG. 7, each rack 32 includes a plurality of gear teeth and an alignment notch 56 on a pin-facing edge thereof and a locking bar-receiving notch 58 on the opposite edge. Preferred pins 26 are generally cup-shaped with a cylindrical sidewall 50 and a finger 52, or gear tooth, extending from the sidewall to engage the gear teeth of the racks 32. As in conventional locks, the pins 26 are disposed in the pin chambers 20 to move with the bitting of the key 78. In the present lock cylinder, however, the engagement of the pins 26 with the racks 32 causes the racks 32 to move up and down in the slots 24. When a valid key 78 is inserted into the lock cylinder 10, as illustrated in FIG. 7, the alignment notches 56 line up with the reset alignment features 48.

The locking bar 34 includes an engaging edge 40 and a locking edge 42, with the locking edge further including a reset notch 42A. When the valid key 78 is inserted into the lock cylinder 10, the engaging edge 40 of the locking bar 34 is aligned with the locking bar-receiving notch 58.

Figure 3:
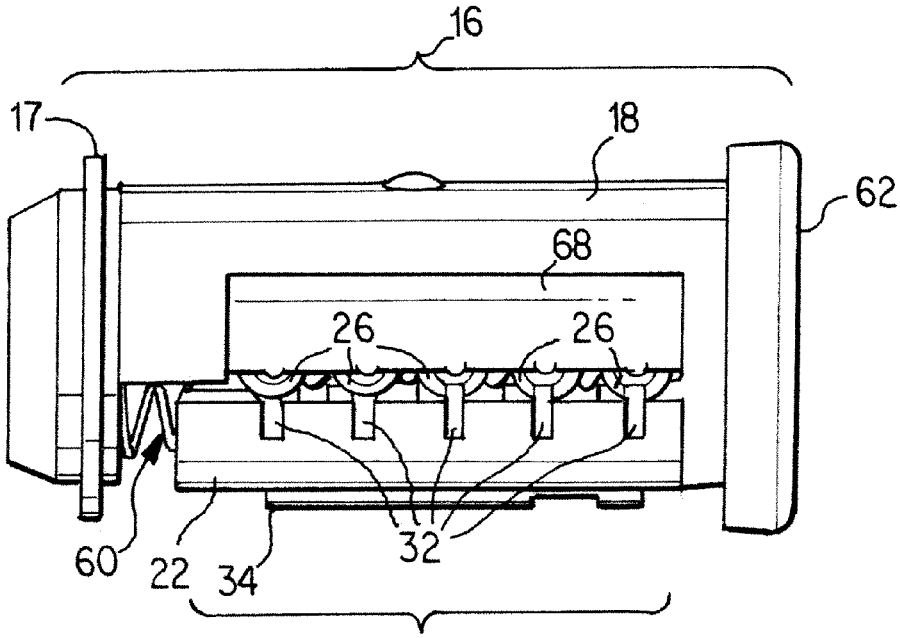
FIG. 3 is a top plan view of the plug assembly of FIG. 2.

FIGS. 2 and 3 illustrate the lock cylinder 10 in the locked condition, but with the cylinder housing 12 removed for clarity. As illustrated, a carrier spring 60 normally biases the carrier 22 toward a forward position adjacent the plug face 62. The locking bar 34 is disposed in the locking bar-receiving chamber 38 and is biased outwardly by the biasing springs 36. FIG. 3 shows the racks 32 engaged with the pins 26 and the locking bar 34 extending beyond the carrier 22.

Figure 4:
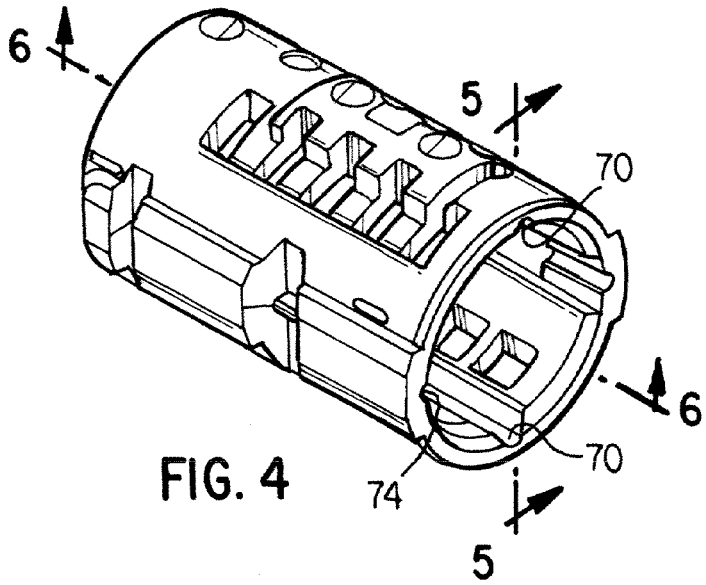
FIG. 4 is a perspective view of the lock cylinder housing of FIG. 1.
Figure 5:
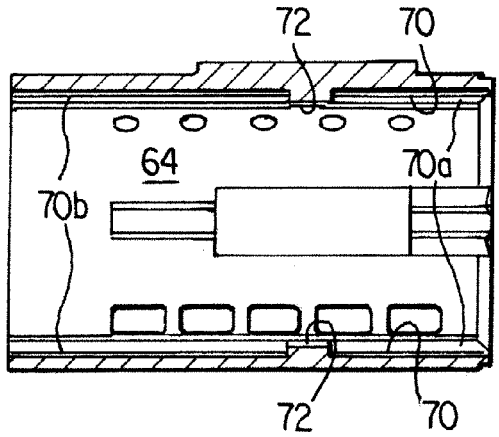
FIG. 5 is a section view taken along lines 5-5 in FIG. 4.
Figure 6:
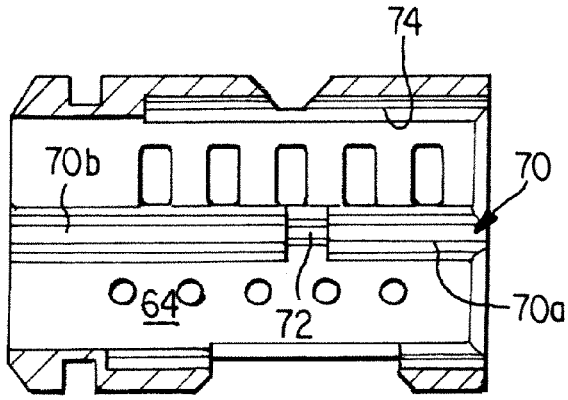
FIG. 6 is a section view taken along lines 6-6 of FIG. 4.

The cylinder housing 12, as seen in FIGS. 4-6, includes a generally cylindrical sidewall, an access panel 66, and a spring retainer 68. The sidewall has an interior surface 64 that defines a pair of diametrically opposed reset grooves 70 and a locking groove 74. The locking groove 74 receives the locking bar 34 when the lock cylinder 10 is in the locked condition (see FIG. 7), while one of the reset grooves 70 receives the locking bar 34 when the lock cylinder is in a learn condition, to be discussed below with respect to FIG. 11.

The reset grooves 70 are segmented into front and back segments 70*a*, 70*b*, respectively, separated by a bridge 72. The bridge 72 is sized and configured to enter the locking bar's reset notch 42*a* to allow the locking bar 34 to enter the reset groove 70. However, the locking bar 34 is normally biased by the carrier spring 60 to prevent alignment of the reset notch 42*a* and the bridge 72.

The illustrated lock cylinder 10 uses two reset grooves 70 to provide two reset positions, but only one reset groove 70 is necessary for the operation of the rekeying function. One of the reset grooves 70 receives the locking bar 34 during a rekeying operation, depending upon which way the key is turned in the lock.

Figure 8:
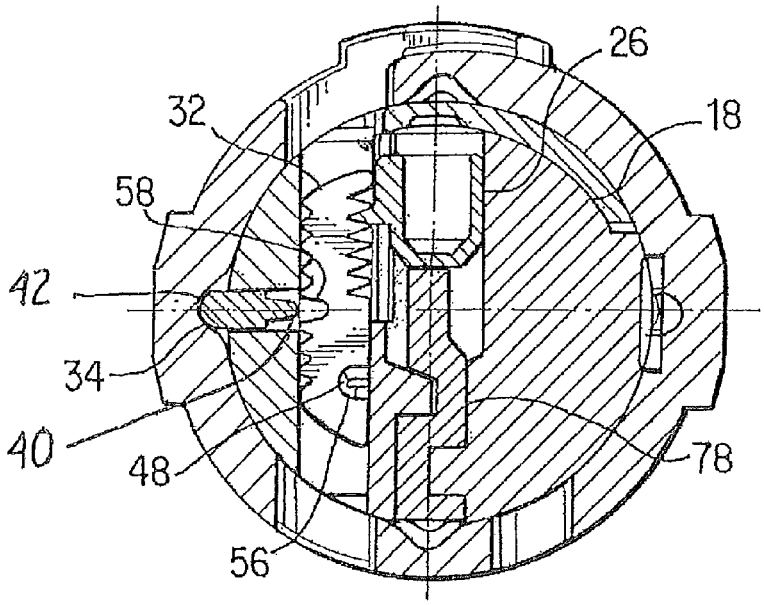
FIG. 8 is a section view through an assembled lock cylinder with a valid key in the keyway.

FIG. 7 illustrates the lock cylinder 10 in the locked condition. The locking bar 34 is retained in the locking groove 74 by the rack 32, thereby preventing the plug assembly 16 from rotating in the cylinder housing 12. FIG. 8 illustrates the lock cylinder 10 with a valid key 78 inserted in the keyway. As illustrated, the pin 26 rides up on the key 78, lifting the rack 32 with it and aligning the rack's locking bar-receiving notch 58 with the locking bar 34. The locking bar-receiving notch 58 provides adequate clearance for the locking bar 34 to cam completely out of the locking groove 74, allowing the plug assembly 16 to rotate in the cylinder housing 12 to the condition illustrated in FIGS. 9-12.

Figure 9:
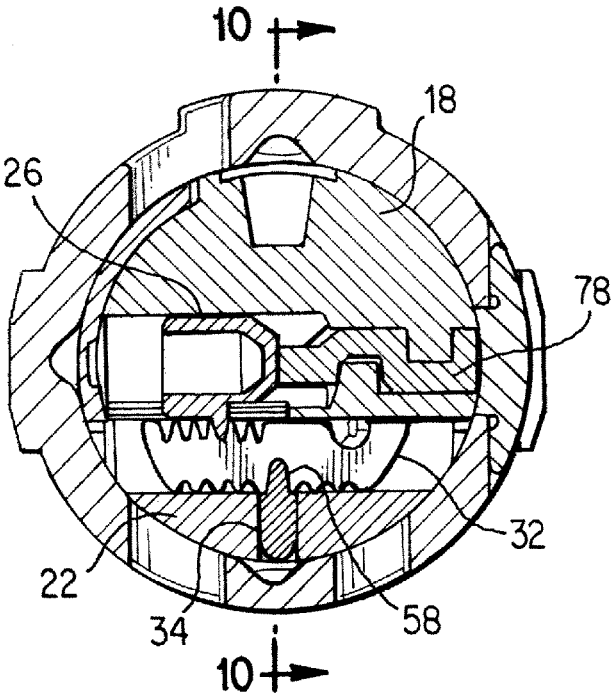
FIG. 9 is a section view through an assembled lock cylinder with the plug assembly rotated 90° in the cylinder housing.
Figure 10:
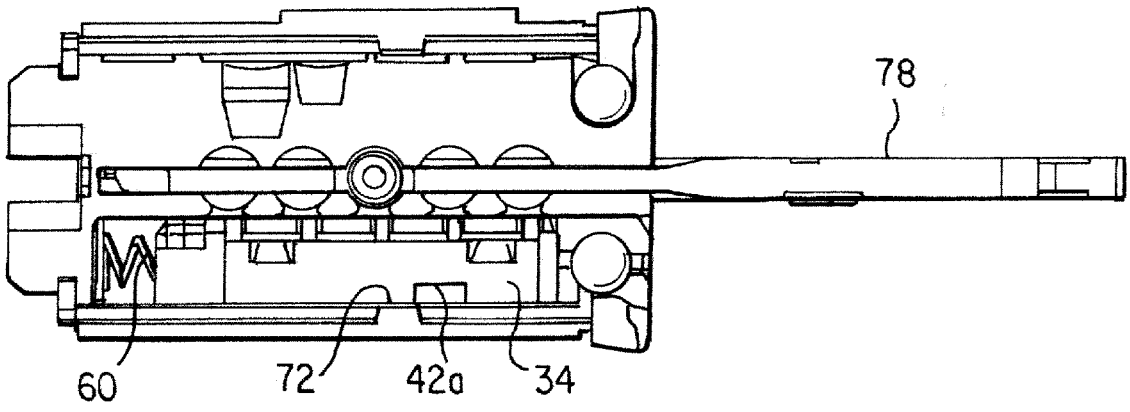
FIG. 10 is a section view taken along lines 10-10 of FIG. 9.

FIGS. 9 and 10 illustrate the lock cylinder 10 wherein the lock cylinder 10 is unlocked and in the reset condition. In this configuration, the locking bar 34 is aligned with one of the reset grooves 70, but the carrier spring 60 is biasing the carrier 22 against the plug face 62, causing a misalignment between the bridge 72 and the lock bar reset notch 42*a*. By virtue of the misalignment, the bridge 72 prevents the locking bar 34 from entering the reset groove 70. However, in this condition, the carrier 22 can be moved longitudinally to the learn position illustrated in FIGS. 11 and 12, wherein the racks 34 are disengaged from the pins 26 and the lock cylinder 10 can be rekeyed.

Figure 11:
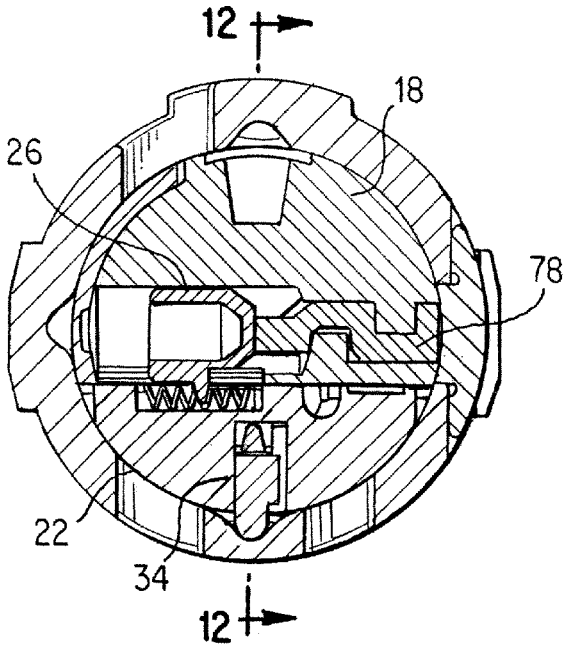
FIG. 11 is a section view through an assembled lock cylinder in the learn configuration.
Figure 12:
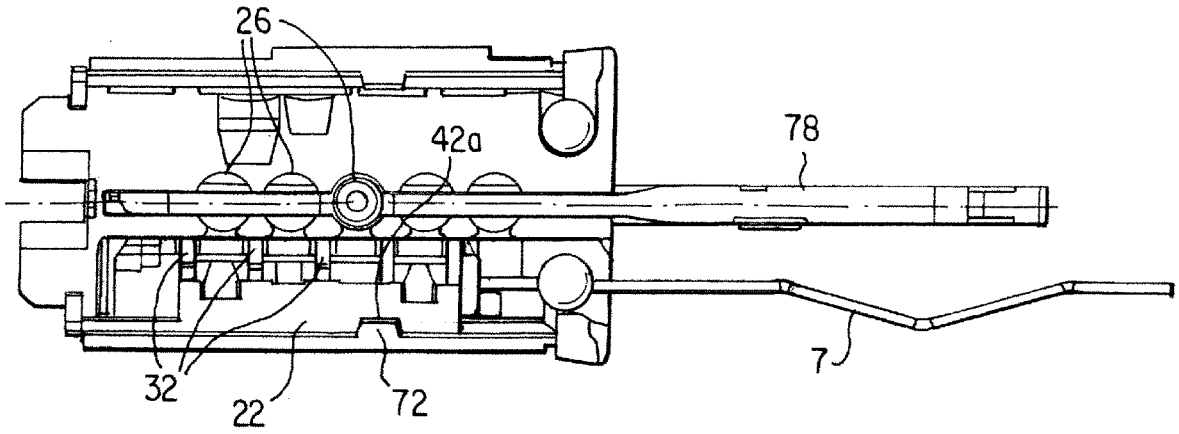
FIG. 12 is a section view taken along lines 12-12 of FIG. 11.

FIGS. 11 and 12 illustrate the carrier 22 to the learn position. A user inserts a reset tool 7 through an aperture 76 formed in the plug face 62 and pushes against the carrier 22. As the carrier 22 moves, multiple actions occur near simultaneously. First, the racks 32 move out of engagement with the pins 26. As the racks 32 disengage from the pins 26, the racks' alignment notches 56 receive the reset alignment features 48, thereby maintaining the alignment between the locking bar 34 and the racks 32. When the racks 32 and pins 26 are completely disengaged, the locking bar's reset notch 42*a* aligns with and receives the bridge 72, allowing the locking bar 34 to enter the reset groove 70 under the biasing force of the springs 36. By entering the reset notch 42*a*, the bridge 72 retains the locking bar 34 and, thereby, the carrier 22 in the learn position.

It will be appreciated by the reset notch and bridge could be switched, such that the cylinder housing sidewall would include the notch and the locking bar would include the bridge. Moving the carrier to the learn position would still result in the engagement of the bridge and notch to retain the carrier in the learn position.

In the learn position, the pins 26 are free to move up and down, thereby allowing the key 78 to be withdrawn and replaced by a different key. As the replacement key is inserted, the pins 26 follow its bitting. When the replacement key is fully inserted, the user rotates the lock cylinder 10 out of the reset condition, thereby camming the locking bar 34 out of the reset groove 70. As the locking bar 34 cams out of the reset groove 70, it once again engages the locking bar-receiving notches of the racks 32. Simultaneously, the bridge 72 exits the locking bar's reset notch 42*a*, allowing the carrier 22 to move longitudinally toward the plug face 62 under the biasing force of the carrier spring 60. As the carrier 22 moves toward the plug face 62, the racks 32 reengage the pins 26, but now the pins 26 and racks 32 are set to match the replacement key.

The above-described embodiments, of course, are not to be construed as limiting the breadth of the present invention. Modifications and other alternative constructions will be apparent that are within the spirit and scope of the invention as defined in the appended claims. For example, the segmented groove in the cylinder housing sidewall could have socket, rather than a bridge, separating the front and back segments. Accordingly, the locking bar would have a projection replacing the notch, and movement of the carrier to the learn position would cause the projection to enter the socket.

The invention claimed is:

1. A rekeyable lock cylinder comprising:

a cylinder housing with a longitudinal axis and a longitudinally extending segmented groove, the segments being separated by a first feature;

a plug body disposed in the cylinder housing for rotation between a home position and a reset position;

a carrier disposed adjacent the plug body for rotation therewith and for longitudinal movement relative thereto between the reset position and a learn position, the carrier including a chamber;

a plurality of pins disposed in the plug body;

a plurality of racks disposed in the carrier, the racks being engaged with the pins when the carrier is in the home and reset positions and disengaged from the pins when the carrier is in the learn position;

a locking bar disposed in the chamber for radial movement relative to the carrier to selectively engage the cylinder housing, the locking bar further including a second feature, the first and second features cooperating to prevent the locking bar from entering the groove when the carrier is in the home position and retaining the locking bar in the groove when the carrier is in the learn position.

2. The lock cylinder of claim 1 wherein one of the first feature and the second feature is a bridge and the other is a notch configured to receive the bridge.

3. A rekeyable lock cylinder comprising:

a cylinder housing with a longitudinal axis and a longitudinally extending segmented groove;

a plug body disposed in the cylinder housing;

a carrier disposed adjacent the plug body for longitudinal movement in the cylinder housing from a first position to a learn position;

a plurality of pins disposed in the plug body;

a plurality of racks disposed in the carrier for engaging the pins;

a segmented locking bar disposed in the carrier, the segmentation of the locking bar being complementary to the segmentation of the groove, the locking bar being disposed in the groove when the carrier is in the learn position and cooperating with the groove to retain the carrier in the learn position.

4. The lock cylinder of claim 3 wherein the segmented groove includes a first segment and a second segment separated by a bridge.

5. The lock cylinder of claim 4 wherein the locking bar includes a first segment and a second segment separated by a notch configured to receive the bridge.

6. A rekeyable lock cylinder comprising:

a cylinder housing with a longitudinal axis and a longitudinally extending groove having at least two segments separated by a first feature formed in the housing;

a plug assembly disposed in the cylinder housing and including a plug body and a carrier, the carrier being movable longitudinally relative to the plug body between a first position and a learn position; and a locking bar configured to enter the groove and having a second feature complementary to the first feature, the first feature engaging the second feature when the carrier is in the learn position, the carrier being retained in the learn position by the engagement between the first and second features.

7. The lock cylinder of claim 6 wherein the first feature includes a bridge and the second feature includes a notch.

8. A method for rekeying a rekeyable lock cylinder comprising the steps of:

providing a cylinder housing having a longitudinal axis and a longitudinally extending groove with at least two segments separated by a first feature formed in the housing;

providing a plug assembly disposed in the cylinder housing, the plug assembly including a plug body and a carrier, the carrier being movable longitudinally relative to the plug body between a first position and a learn position;

providing a locking bar having a second feature complementary to the first feature and configured to enter the groove, the first feature engaging the second feature when the locking bar is in the groove, the carrier being retained in the learn position by the engagement between the first and second features;

while the plug assembly is in a home position, inserting a valid key into the plug assembly and rotating the plug assembly;

moving the carrier to the learn position and, while the carrier is in the learn position, removing the valid key and inserting a replacement key; and rotating the plug assembly to the home position.

9. The method of claim 8 wherein the step of moving the carrier to the learn position includes the step of moving the locking bar into the groove.

10. The method of claim 8 wherein the step of rotating the plug assembly to the home position includes the step of releasing the locking bar from the groove.

11. The method of claim 10 wherein the step of releasing the locking bar includes the step of biasing the carrier from the learn position to the first position.

* * * * *